US009593640B2

(12) United States Patent
Zahdeh et al.

(10) Patent No.: US 9,593,640 B2
(45) Date of Patent: Mar. 14, 2017

(54) ENGINE ASSEMBLY INCLUDING CYLINDER HEAD COOLING

(75) Inventors: Akram R. Zahdeh, Rochester Hills, MI (US); Naser I. Hineiti, Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 954 days.

(21) Appl. No.: 13/052,178

(22) Filed: Mar. 21, 2011

(65) Prior Publication Data

US 2012/0240884 A1 Sep. 27, 2012

(51) Int. Cl.

| | |
|---|---|
| ***F02F 1/14*** | (2006.01) |
| ***F02F 1/40*** | (2006.01) |
| *F01P 3/02* | (2006.01) |
| *F02F 1/10* | (2006.01) |

(52) U.S. Cl.

CPC ..... *F02F 1/40* (2013.01); *F01P 2003/028* (2013.01); *F02F 2001/106* (2013.01)

(58) Field of Classification Search

USPC ..... 123/41.79, 41.82 R, 193.5, 41.74, 41.72; 29/888.06

See application file for complete search history.

(56) References Cited

U.S. PATENT DOCUMENTS

| | | | | |
|---|---|---|---|---|
| 4,730,579 | A * | 3/1988 | Yamada et al. | 123/41.82 R |
| 4,993,227 | A * | 2/1991 | Nagura et al. | 60/605.1 |
| 5,207,210 | A * | 5/1993 | Yamagata et al. | 123/661 |
| 6,997,144 | B2 * | 2/2006 | Sugano et al. | 123/41.82 R |
| 7,086,355 | B2 * | 8/2006 | Yamamoto | 123/41.72 |
| 7,225,766 | B2 | 6/2007 | Zahdeh | |
| 7,234,422 | B2 * | 6/2007 | Schlautman et al. | 123/41.74 |
| 7,980,206 | B2 * | 7/2011 | Nagafuchi | 123/41.82 R |

FOREIGN PATENT DOCUMENTS

| | | |
|---|---|---|
| DE | 3603674 A1 | 8/1987 |
| DE | 102009008237 A1 | 10/2010 |

* cited by examiner

*Primary Examiner* — Lindsay Low
*Assistant Examiner* — Omar Morales
(74) *Attorney, Agent, or Firm* — Harness, Dickey & Pierce, P.L.C.

(57) ABSTRACT

An engine assembly includes an engine block, a cylinder head coupled to the engine block with a cooling system running through both. The engine block defines a first cylinder bore and a first cylinder cooling jacket at an outer periphery of the first cylinder bore. The cylinder head defines a first port cooling jacket for a first set of ports in communication with the first cylinder bore. The coolant supply is in communication with the first cylinder cooling jacket and the first port cooling jacket. The first port cooling jacket defines a first head coolant flow path in a parallel flow arrangement with a coolant flow path defined by the first cylinder cooling jacket.

15 Claims, 3 Drawing Sheets

ENGINE ASSEMBLY INCLUDING CYLINDER HEAD COOLING

FIELD

The present disclosure relates to engine cooling systems, and more specifically cylinder head cooling arrangements.

BACKGROUND

This section provides background information related to the present disclosure which is not necessarily prior art.

Internal combustion engines may combust a mixture of air and fuel in cylinders and thereby produce drive torque. Combustion of the air-fuel mixture generates heat to move the piston generating torque. Some of the unused energy is absorbed by the engine structure that is then transferred to an engine cooling system.

SUMMARY

An engine assembly may include an engine block, a cylinder head coupled to the engine block and a coolant supply. The engine block may define a first cylinder bore and a first cylinder cooling jacket at an outer periphery of the first cylinder bore. The cylinder head may define a first port cooling jacket for a first set of ports in communication with the first cylinder bore. The coolant supply may be in communication with the first cylinder cooling jacket and the first port cooling jacket. The first port cooling jacket may define a first head coolant flow path in a parallel flow arrangement with a coolant flow path defined by the first cylinder cooling jacket.

In another arrangement, an engine assembly may include an engine block, a cylinder head coupled to the engine block and a coolant supply. The engine block may define a first cylinder bore and a first cylinder cooling jacket at an outer periphery of the first cylinder bore. The cylinder head may be coupled to the engine block and may define a first port cooling jacket for a first set of ports in communication with the first cylinder bore. The first set of ports may include first and second ports. The first port cooling jacket may include a first region extending around the first port, a second region extending around the second port, a first coolant feed passage extending to the first region and a second coolant feed passage extending to the second region. The coolant supply may be in communication with the first cylinder cooling jacket, the first coolant feed passage and the second coolant feed passage.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
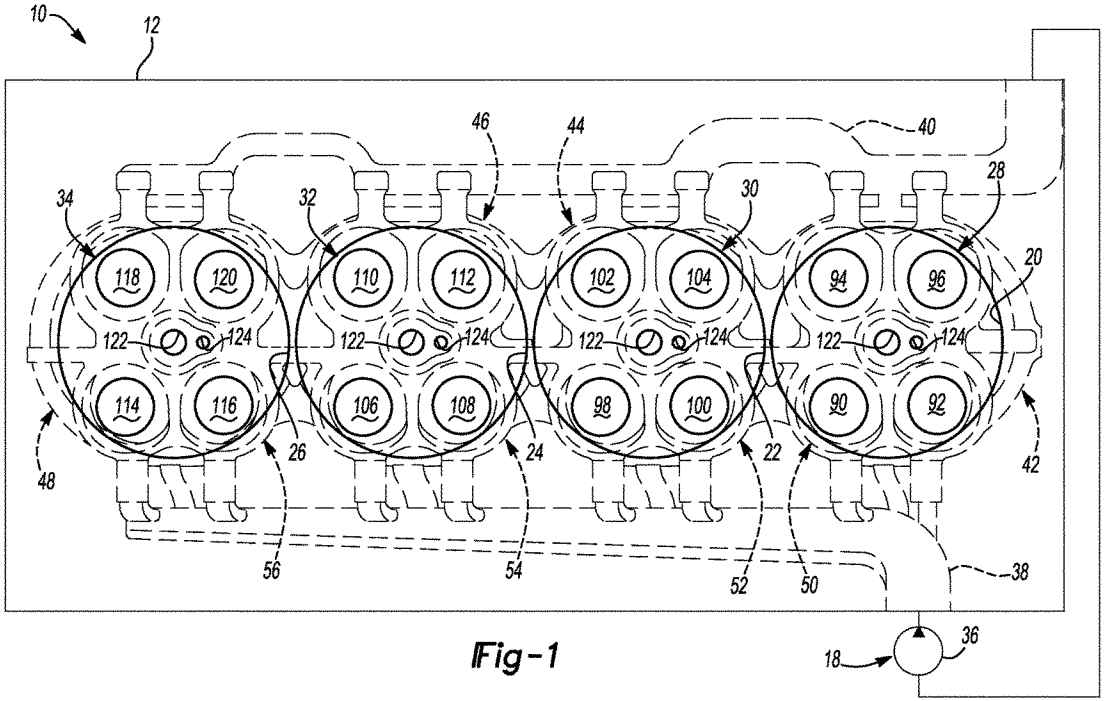
FIG. 1 is a schematic illustration of an engine assembly according to the present disclosure.
Figure 2:
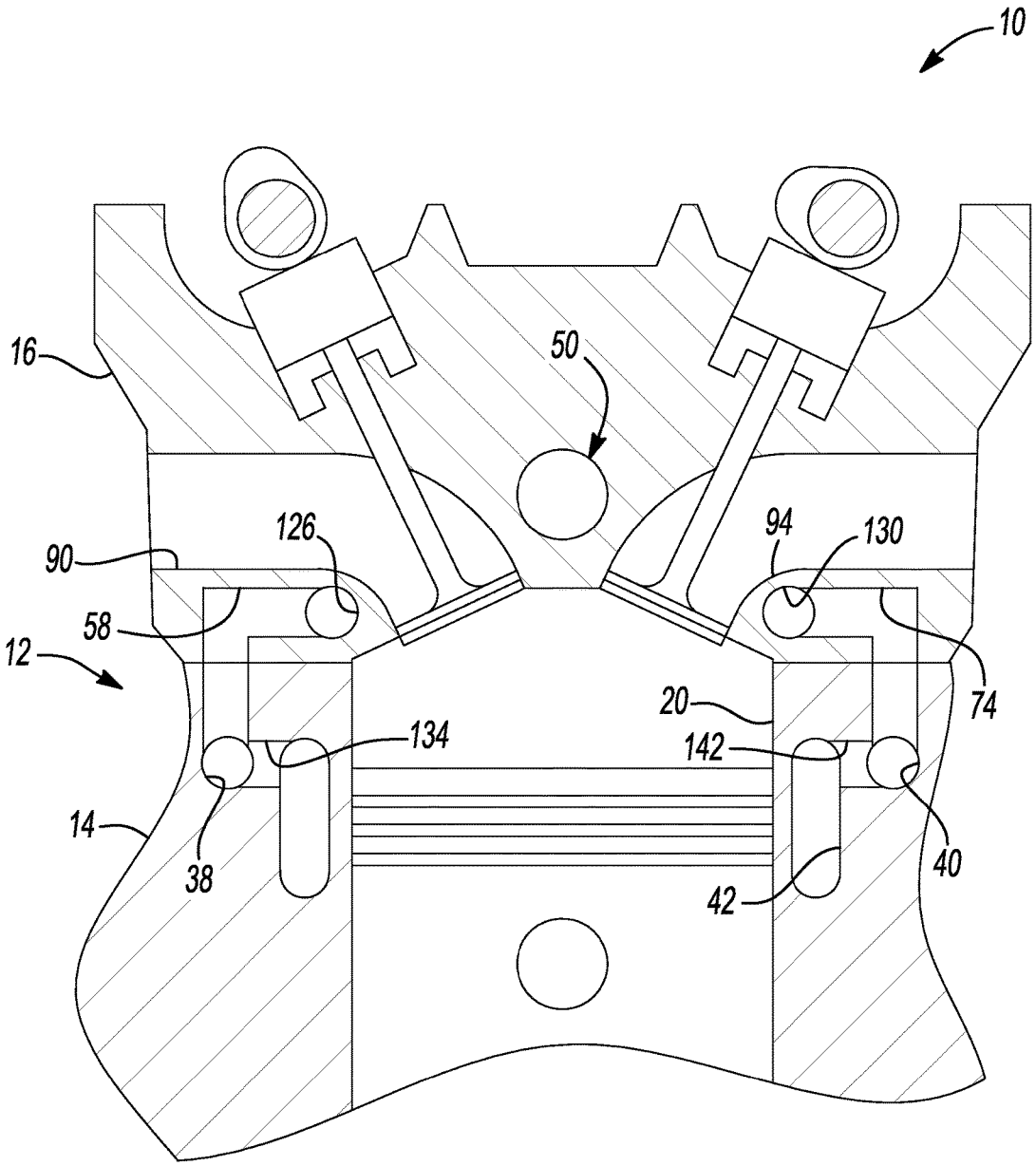
FIG. 2 is a schematic section view of the engine assembly of FIG. 1.
Figure 3:
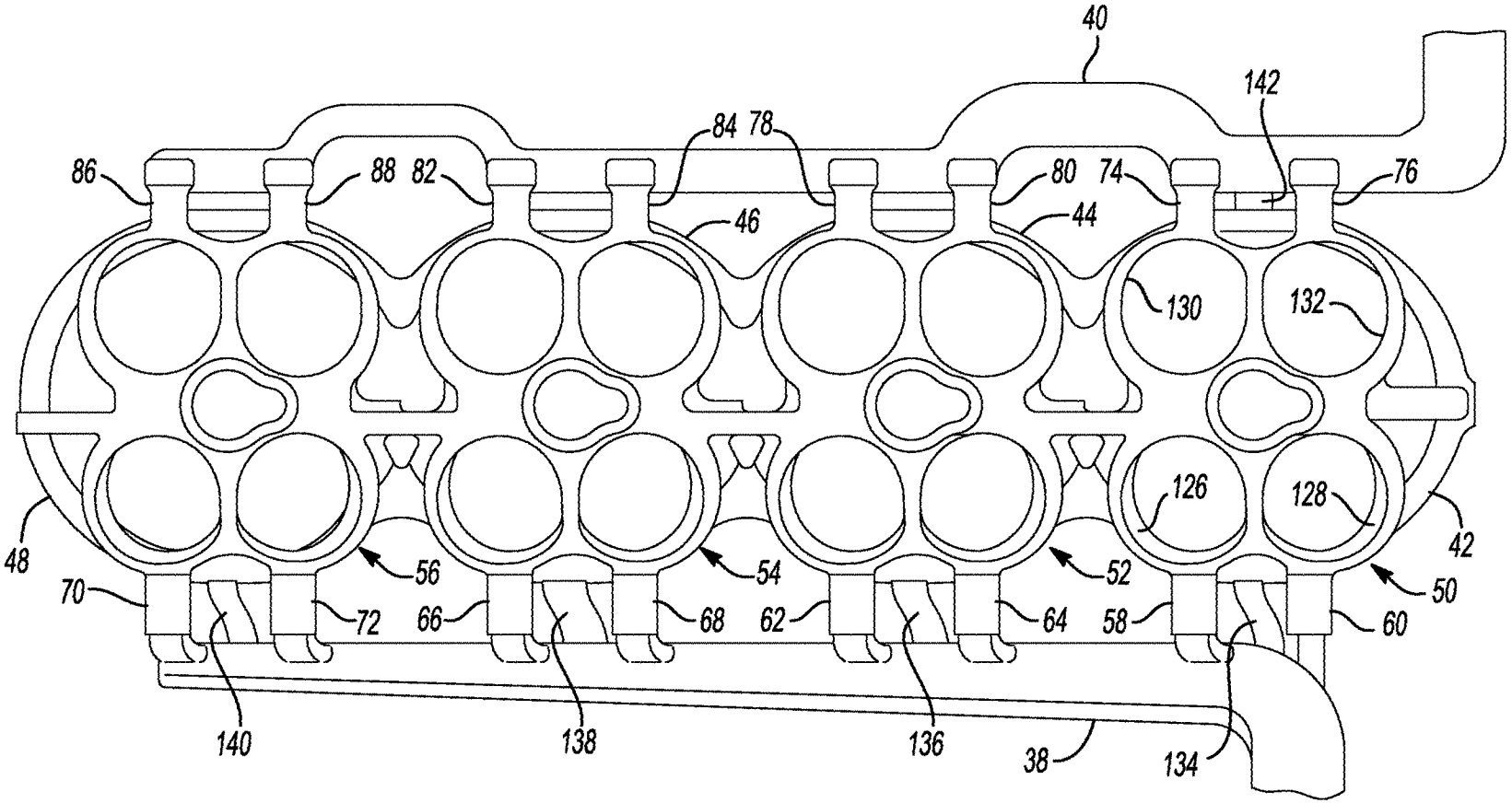
FIG. 3 is an illustration of coolant passages in the engine assembly of FIG. 1.

An engine assembly 10 is illustrated in FIGS. 1-3 and may include an engine structure 12 defining an engine block 14, a cylinder head 16 coupled to the engine block 14 and a cooling system 18. The engine block 14 may define a first cylinder bore 20, a second cylinder bore 22, a third cylinder bore 24 and a fourth cylinder bore 26. In the present non-limiting example, the first and second cylinder bores 20, 22 are adjacent to one another, the second and third cylinder bores 22, 24 are adjacent to one another and the third and fourth cylinder bores 24, 26 are adjacent to one another, forming an inline four cylinder arrangement. However, while illustrated in combination with an inline four cylinder arrangement, the present disclosure applies to any number of piston-cylinder arrangements and a variety of reciprocating engine configurations including, but not limited to, V-engines, inline engines, and horizontally opposed engines, as well as both overhead cam and cam-in-block configurations.

The cylinder head 16 may define a first set of ports 28 in communication with the first cylinder bore 20, a second set of ports 30 in communication with the second cylinder bore 22, a third set of ports 32 in communication with the third cylinder bore 24, and a fourth set of ports 34 in communication with the fourth cylinder bore 26. The cooling system 18 may include a coolant supply from a coolant pump 36 in communication with a coolant supply passage 38 and a coolant return passage 40 formed in the engine structure 12.

In the present non-limiting example, the engine block 14 defines first, second, third and fourth cylinder cooling jackets 42, 44, 46, 48 and the cylinder head 16 defines first, second, third and fourth port cooling jackets 50, 52, 54, 56. The first cylinder cooling jacket 42 may be defined at an outer periphery of the first cylinder bore 20, the second cylinder cooling jacket 44 may be defined at an outer periphery of the second cylinder bore 22, the third cylinder cooling jacket 46 may be defined at an outer periphery of the third cylinder bore 24 and the fourth cylinder cooling jacket 48 may be defined at an outer periphery of the fourth cylinder bore 26.

The first port cooling jacket 50 may extend around the first set of ports 28, the second port cooling jacket 52 may extend around the second set of ports 30, the third port cooling jacket 54 may extend around the third set of ports 32 and the fourth port cooling jacket 56 may extend around the fourth set of ports 34. In the present non-limiting example, the engine structure 12 defines first and second coolant feed passages 58, 60 in the cylinder head 16 extending from the coolant supply passage 38 to the first port cooling jacket 50. The engine structure 12 may similarly define first and second coolant feed passages 62, 64 in the cylinder head 16 extending from the coolant supply passage 38 to the second port cooling jacket 52, first and second coolant feed passages 66, 68 extending from the coolant supply passage 38 to the third port cooling jacket 54 and first and second coolant feed passages 70, 72 extending from the coolant supply passage 38 to the fourth port cooling jacket 56.

The engine structure 12 may additionally define first and second coolant outlet passages 74, 76 in the cylinder head 16 extending from the first port cooling jacket 50 to the coolant return passage 40. The engine structure 12 may similarly define first and second coolant outlet passages 78, 80 in the cylinder head 16 extending from the second port cooling jacket 52 to the coolant return passage 40, first and second coolant outlet passages 82, 84 extending from the third port cooling jacket 54 to the coolant return passage 40 and first and second coolant outlet passages 86, 88 extending from the fourth port cooling jacket 56 to the coolant return passage 40.

The first set of ports 28 may include a first port 90, a second port 92, a third port 94 and a fourth port 96. Similarly the second set of ports 30 may include four ports 98, 100, 102, 104, the third set of ports 32 may include four ports 106, 108, 110, 112, and the fourth set of ports 34 may include four ports 114, 116, 118, 120. The first ports 90, 98, 106, 114 and the second ports 92, 100, 108, 116 may each form exhaust ports. The third ports 94, 102, 110, 118 and the fourth ports 96, 104, 112, 120 may each form intake ports. The engine structure 12 may additionally define spark plug openings 122 and fuel injector openings 124 in the cylinder head 16 for each cylinder bore. While shown as a central direct injection arrangement, the present disclosure is not limited to such arrangements and applies equally to a variety of other arrangements including, but not limited to, port injection and other direct injection arrangements.

The first, second, third and fourth port cooling jackets 50, 52, 54, 56 may be similar to one another. Therefore, for simplicity, only the first port cooling jacket 50 will be described below with the understanding that the description applies equally to the second, third and fourth port cooling jackets 52, 54, 56. The first port cooling jacket 50 may define a first region 126 extending around the first port 90, a second region 128 extending around the second port 92, a third region 130 extending around the third port 94 and a fourth region 132 extending around the fourth port 96. The first, second, third and fourth regions 126, 128, 130, 132 may define a central region surrounding the spark plug opening 122 and the fuel injector opening 124.

In the present non-limiting example, the first region 126 extends around the entire circumference of the first port 90, the second region 128 extends around the entire circumference of the second port 92, the third region 130 extends around the entire circumference of the third port 94 and the fourth region 132 extends around the entire circumference of the fourth port 96. The first coolant feed passage 58 may extend from the coolant supply passage 38 to the first region 126 and the second coolant feed passage 60 may extend from the coolant supply passage 38 to the second region 128. The first coolant outlet passage 74 may extend from the third region 130 to the coolant return passage 40 and the second coolant outlet passage 76 may extend from the fourth region 132 to the coolant return passage 40.

The first coolant feed passage 58 may provide a first flow path including coolant flow through the first and third regions 126, 130 of the first port cooling jacket 50 laterally across the cylinder head 16 to the first coolant outlet passage 74. More specifically, the first flow path may include flow from the first coolant feed passage 58 to the first region 126 around the circumference of the first port 90 to the third region 130 around the circumference of the third port 94 to the first coolant outlet passage 74. Similarly, the second coolant feed passage 60 may provide a second flow path including coolant flow through the second and fourth regions 128, 132 of the first port cooling jacket 50 laterally across the cylinder head 16 to the second coolant outlet passage 76. More specifically, the second flow path may include flow from the second coolant feed passage 60 to the second region 128 around the circumference of the second port 92 to the fourth region 132 around the circumference of the fourth port 96 to the second coolant outlet passage 76. The first and second flow paths may define parallel flow paths across the cylinder head 16.

The first port cooling jacket 50 may define a first head coolant flow path laterally across the cylinder head 16, the second port cooling jacket 52 may define a second head coolant flow path laterally across the cylinder head 16, the third port cooling jacket 54 may define a third head coolant flow path laterally across the cylinder head 16, and the fourth port cooling jacket 56 may define a first head coolant flow path laterally across the cylinder head 16. The first, second, third and fourth head coolant flow paths may define parallel flow paths from the coolant supply passage 38 to the coolant return passage 40 (i.e., a parallel flow path arrangement where coolant does not need to flow in series through the first, second, third and fourth port cooling jackets 50, 52, 54, 56).

The first, second, third and fourth head coolant flow paths may additionally form parallel flow paths from the coolant supply passage 38 to the coolant return passage 40 relative to the cylinder coolant flow path defined by the first, second, third and fourth cylinder cooling jackets 42, 44, 46, 48 (i.e., a parallel flow path arrangement where coolant does not need to flow to the first, second, third or fourth cylinder cooling jackets 42, 44, 46, 48 before flowing to the first, second, third and fourth port cooling jackets 50, 52, 54, 56). The engine structure 12 may define first, second, third and fourth cylinder cooling jacket feed passages 134, 136, 138, 140 and a coolant outlet passage 142 in the engine block 14.

In the present non-limiting example, the first cylinder cooling jacket feed passage 134 extends from the coolant supply passage 38 to the first cylinder cooling jacket 42, the second cylinder cooling jacket feed passage 136 extends from the coolant supply passage 38 to the second cylinder cooling jacket 44, the third cylinder cooling jacket feed passage 138 extends from the coolant supply passage 38 to the third cylinder cooling jacket 46, the fourth cylinder cooling jacket feed passage 140 extends from the coolant supply passage 38 to the fourth cylinder cooling jacket 48, and the coolant outlet passage 142 extends from the first cylinder cooling jacket 42 to the coolant return passage 40. Therefore, the first, second, third and fourth cylinder cooling jackets 42, 44, 46, 48 and the first, second, third and fourth port cooling jackets 50, 52, 54, 56 may each be in communication with the coolant supply independent from one another.

What is claimed is:

1. An engine assembly comprising:

an engine block defining a first cylinder bore and a first cylinder cooling jacket at an outer periphery of the first cylinder bore;

a cylinder head coupled to the engine block and defining a first set of four ports in communication with the first cylinder bore and a first port cooling jacket including a first region completely surrounding a first one of the first set of four ports, a second region completely surrounding a second one of the first set of four ports, a third region completely surrounding a third one of the first set of four ports and a fourth region completely surrounding a fourth one of the first set of four ports; and a coolant supply passage extending through the engine block and in communication with each of the first cylinder cooling jacket and the first port cooling jacket, the first port cooling jacket defining a first coolant feed passage directly connected to the coolant supply passage and the first region of the first port cooling jacket and a second coolant feed passage separate from the first coolant feed passage and directly connected to the coolant supply passage and the second region of the first port cooling jacket, the first port cooling jacket defining a first coolant outlet passage connected to a coolant return passage extending through the engine block on an opposite side of the first cylinder bore from the coolant supply passage and directly connected to the third region of the first port cooling jacket and a second coolant outlet passage separate from the first coolant outlet passage and connected to the coolant return passage and directly connected to the fourth region of the first port cooling jacket.

2. The engine assembly of claim 1, wherein the engine block defines a second cylinder bore adjacent to the first cylinder bore and a second cylinder cooling jacket at an outer periphery of the second cylinder bore and the cylinder head defines a second set of four ports in communication with the second cylinder bore and a second port cooling jacket including a first region surrounding a first one of the second set of four ports, a second region surrounding a second one of the second set of four ports, a third region surrounding a third one of the second set of four ports and a fourth region surrounding a fourth one of the second set of four ports in communication with the second cylinder bore, the second port cooling jacket being in communication with the coolant supply passage and defining a second head coolant flow path parallel to a first head coolant flow path.

3. The engine assembly of claim 2, wherein the second cylinder cooling jacket is in communication with the coolant supply passage and in a parallel flow arrangement with the second head coolant flow path.

4. The engine assembly of claim 2, wherein the first head coolant flow path and the second head coolant flow path extend laterally across the cylinder head and define a parallel flow arrangement across the cylinder head.

5. The engine assembly of claim 1, wherein the first coolant feed passage provides coolant flow through the first and third regions of the first port cooling jacket laterally across the cylinder head to the first coolant outlet passage and the second coolant feed passage provides coolant flow through the second and fourth regions of the first port cooling jacket laterally across the cylinder head to the second coolant outlet passage.

6. The engine assembly of claim 1, wherein the first region extends around an entire circumference of the first port, the second region extends around an entire circumference of the second port, the third region extends around an entire circumference of the third port and the fourth region extends around an entire circumference of the fourth port.

7. The engine assembly of claim 6, wherein a first flow path is defined from the first coolant feed passage to the first region around the circumference of the first port to the third region around the circumference of the third port to the first coolant outlet passage and a second flow path is defined from the second coolant feed passage to the second region around the circumference of the second port to the fourth region around the circumference of the fourth port to the second coolant outlet passage.

8. The engine assembly of claim 1, wherein the engine block defines a cylinder cooling jacket feed passage extending from the coolant supply passage to the first cylinder cooling jacket.

9. An engine assembly comprising:

an engine block defining a first cylinder bore and a first cylinder cooling jacket at an outer periphery of the first cylinder bore;

a cylinder head coupled to the engine block and defining a first port cooling jacket for a first set of ports in communication with the first cylinder bore, the first set of ports including first and second ports and the first port cooling jacket including a first region extending completely around the first port, a second region extending completely around the second port, a first coolant feed passage extending to the first region and a second coolant feed passage extending to the second region; and a coolant supply passage extending through the engine block and in direct communication with the first cylinder cooling jacket, the first coolant feed passage and the second coolant feed passage, the first coolant feed passage, the second coolant feed passage and the first cylinder cooling jacket each being directly connected to a coolant return passage extending through the engine block on an opposite side of the first cylinder bore from the coolant supply passage.

10. The engine assembly of claim 9, wherein the engine block defines a second cylinder bore adjacent to the first cylinder bore and a second cylinder cooling jacket at an outer periphery of the second cylinder bore and in communication with the coolant supply passage and the cylinder head defines a second port cooling jacket for a second set of ports in communication with the second cylinder bore, the second port cooling jacket extending around the second set of ports and defining a third coolant feed passage and a fourth coolant feed passage in communication with the coolant supply passage, the first and second port cooling jackets defining parallel coolant flow paths laterally across the cylinder head.

11. The engine assembly of claim 9, wherein the first set of ports in the cylinder head includes a third port and a fourth port and the first port cooling jacket includes a third region extending around the third port, a fourth region extending around the fourth port, a first coolant outlet passage extending from the third region and a second coolant outlet passage extending from the fourth region.

12. The engine assembly of claim 11, wherein the first coolant feed passage provides coolant flow through the first and third regions of the first port cooling jacket laterally across the cylinder head to the first coolant outlet passage and the second coolant feed passage provides coolant flow through the second and fourth regions of the first port cooling jacket laterally across the cylinder head to the second coolant outlet passage.

13. The engine assembly of claim 11, wherein the first region extends around an entire circumference of the first port, the second region extends around an entire circumference of the second port, the third region extends around an entire circumference of the third port and the fourth region extends around an entire circumference of the fourth port.

14. The engine assembly of claim 13, wherein a first flow path is defined from the first coolant feed passage to the first region around the circumference of the first port to the third region around the circumference of the third port to the first coolant outlet passage and a second flow path is defined from the second coolant feed passage to the second region around the circumference of the second port to the fourth region around the circumference of the fourth port to the second coolant outlet passage.

15. The engine assembly of claim 9, wherein the engine block defines a cylinder cooling jacket feed passage extending from the coolant supply passage to the first cylinder cooling jacket and first and second coolant feed passages extending from the coolant supply passage to the first port cooling jacket.

* * * * *